US008827411B2

(12) United States Patent
Makimoto

(10) Patent No.: US 8,827,411 B2
(45) Date of Patent: Sep. 9, 2014

(54) INKJET RECORDING APPARATUS

(71) Applicant: Fujifilm Corporation, Tokyo (JP)

(72) Inventor: Akihiro Makimoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/850,937

(22) Filed: Mar. 26, 2013

(65) Prior Publication Data

US 2013/0257965 A1 Oct. 3, 2013

(30) Foreign Application Priority Data

Mar. 27, 2012 (JP) ..... 2012-071640

(51) Int. Cl.

| | |
|---|---|
| ***B41J 29/38*** | (2006.01) |
| ***B41J 2/165*** | (2006.01) |
| ***B41J 11/00*** | (2006.01) |
| ***B41J 2/045*** | (2006.01) |
| ***B41J 2/175*** | (2006.01) |
| ***B41J 29/377*** | (2006.01) |

(52) U.S. Cl.

CPC ..... *B41J 2/04563* (2013.01); *B41J 11/002* (2013.01); *B41J 2/175* (2013.01); *B41J 2/17596* (2013.01); *B41J 29/38* (2013.01); *B41J 29/377* (2013.01)

USPC ..... 347/17; 347/29; 347/32

(58) Field of Classification Search

CPC ..... B41J 2/16508; B41J 2/16511; B41J 2/16547; B41J 2/16588

USPC ..... 347/17, 29, 32

See application file for complete search history.

(56) References Cited

U.S. PATENT DOCUMENTS

| | | | | |
|---|---|---|---|---|
| 5,870,115 | A * | 2/1999 | Kikuchi et al. | 347/32 |
| 2004/0223028 | A1 | 11/2004 | Yokoyama et al. | |
| 2006/0221167 | A1 * | 10/2006 | Maynard et al. | 347/108 |
| 2009/0067868 | A1 * | 3/2009 | Arizumi et al. | 399/67 |
| 2010/0149297 | A1 | 6/2010 | Kanada | |

(Continued)

FOREIGN PATENT DOCUMENTS

| | | | |
|---|---|---|---|
| EP | 1468834 | A1 | 10/2004 |
| JP | 06-340080 | A | 12/1994 |

(Continued)

OTHER PUBLICATIONS

Kubota, "MachineTranslationof-JP2006-264264A.pdf", 2006.*

(Continued)

*Primary Examiner* — Geoffrey Mruk
*Assistant Examiner* — Scott A Richmond
(74) *Attorney, Agent, or Firm* — Studebaker & Brackett PC

(57) ABSTRACT

An inkjet recording apparatus according to an aspect of the present invention includes: a carriage incorporating an image forming unit which forms an image on a recording medium by ejecting ink from an inkjet head; a scanning device which scans the recording medium by bi-directionally moving the carriage along a direction perpendicular to a direction of conveyance of the recording medium; a platen arranged opposite the carriage and supporting the recording medium from a rear surface side thereof; and a temperature control device carrying out temperature control of the platen by a temperature adjustment mechanism provided on the carriage or is provided detachably, wherein the temperature control device carries out temperature control throughout the whole range of the platen in the width direction, by moving the carriage by the scanning device.

16 Claims, 10 Drawing Sheets

(56) References Cited

U.S. PATENT DOCUMENTS

| | | | | |
|---|---|---|---|---|
| 2010/0245513 | A1 | 9/2010 | Ihara | |
| 2012/0147080 | A1* | 6/2012 | Kodaira | 347/17 |
| 2012/0229582 | A1 | 9/2012 | Ihara | |

FOREIGN PATENT DOCUMENTS

| | | | | |
|---|---|---|---|---|
| JP | H09-164701 | A | | 6/1997 |
| JP | H09-193408 | A | | 7/1997 |
| JP | H11-20144 | A | | 1/1999 |
| JP | 2000-255042 | A | | 9/2000 |
| JP | 2004322560 | A | | 11/2004 |
| JP | 2005104019 | A | | 4/2005 |
| JP | 2006264264 | A | * | 10/2006 |
| JP | 2007-276171 | A | | 10/2007 |
| JP | 2009-073023 | A | | 4/2009 |

OTHER PUBLICATIONS

The extended European Search Report issued on Jul. 17, 2013, which corresponds to EP 13161063.6 and is related to U.S. Appl. No. 13/850,937.

An Office Action; "Notification of Reasons for Rejection," issued by the Japanese Patent Office on Feb. 3, 2014, which corresponds to Japanese Patent Application No. 2012-071640 and is related to U.S. Appl. No. 13/850,937; with English language partial translation.

* cited by examiner

INKJET RECORDING APPARATUS

BACKGROUND OF THE INVENTION

1. Field of the Invention

The present invention relates to an inkjet recording apparatus, and more particularly, to technology for adjusting a temperature of a platen.

2. Description of the Related Art

Conventionally, image formation is performed onto a recording medium by ejecting ink from an inkjet head onto a recording surface of a recording medium. In image formation by an inkjet recording apparatus of this kind, an image is formed by supporting a recording medium on a platen, or the like, from an opposite side to a surface of the recording medium where an image is to be formed. In this case, desirably, the temperature of the platen is set to no less than room temperature, in order to rapidly fix the ink so as to obtain an optimal image.

For example, Japanese Patent Application Publication No. 2009-73023 describes a liquid ejection apparatus which is provided with a heating device for heating a platen from a rear surface, thereby previously heating the recording medium, and which performs heating by a hot air flow after image forming, thereby heating the recording medium from both surfaces. Furthermore, Japanese Patent Application Publication No. 6-340080 describes an inkjet recording apparatus which is provided with a cap that closes off ejection ports of an inkjet head during supply of printing paper, a heater being arranged inside this cap so as to make the temperature of the cap higher than the ejection ports, thereby improving the long-term storage properties of the head.

SUMMARY OF THE INVENTION

However, in the liquid ejection apparatus described in Japanese Patent Application Publication No. 2009-73023, a heater is provided inside the platen in order to heat up the platen, resulting in a structure which is large in size and leading to increased costs of the apparatus. Furthermore, although reference is made to heating the platen, there is no investigation into cooling of the platen. Furthermore, Japanese Patent Application Publication No. 6-340080 describes providing a heater in the cap, but does not describe using a heater for temperature control of the platen.

If it is necessary to set the temperature of the platen to no less than the room temperature, then a user must wait for the temperature of the platen to reach the set value, and if the set value is different depending on the base material, and in particular, if it is necessary to cool the platen, then the waiting time for the user becomes very long, leading to a decline in production efficiency. In order to resolve these issues, it is effective to add a temperature adjustment mechanism, but if this is arranged over the whole platen, then there are concerns in that the structure becomes very large and the cost of the apparatus is increased.

The present invention was devised in view of these circumstances, an object thereof being to shorten a temperature adjustment time and to achieve a compact size of an apparatus, by using a head driving mechanism to perform temperature adjustment of a platen.

In order to achieve the above object, the present invention provides an inkjet recording apparatus, including: a carriage incorporating an image forming unit which forms an image on a recording medium by ejecting ink from an inkjet head; a scanning device which scans the recording medium by bi-directionally moving the carriage along a direction perpendicular to a direction of conveyance of the recording medium; a platen arranged opposite the carriage and supporting the recording medium from a rear surface side thereof; and a temperature control device carrying out temperature control of the platen by a temperature adjustment mechanism provided on the carriage or is provided detachably, wherein the temperature control device carries out temperature control throughout the whole range of the platen in the width direction, by moving the carriage by the scanning device.

According to the present invention, temperature adjustment of the platen is carried out by performing a scanning action (bi-directional moving) of the carriage, using a temperature adjustment mechanism which is provided on the carriage or which is provided detachably. Therefore, it is possible to reduce the size and the cost of the equipment. Furthermore, by using the scanning device to carry out heating of the platen, it is possible to perform heating efficiently.

In an inkjet recording apparatus according to a further aspect of the present invention, it is preferable that the temperature adjustment mechanism is a heat insulating pipe and a heater which are arranged, inside the carriage, along a moving direction of the carriage.

According to the inkjet recording apparatus relating to the further aspect of the present invention, by forming the temperature adjustment mechanism as a heat insulating pipe and a heater which are provided inside the carriage, it is possible to heat the air that passes through the heat insulating pipe due to the scanning action of the carriage, by means of the heater. Consequently, it is possible to blow a flow of warm air onto the platen and therefore heating of the platen can be performed. Furthermore, if heat is not applied to the heater, then it is possible to cool the platen by the air passing through the heat insulating pipe.

In an inkjet recording apparatus according to a further aspect of the present invention, it is preferable that the temperature adjustment mechanism is a heat insulating pipe and a heat sink which are arranged, inside the carriage, along a scanning direction of the carriage.

According to the inkjet recording apparatus relating to the further aspect of the present invention, it is possible to blow a flow of cold air onto the platen, by cooling the air passing through the heat insulating pipe by a heat sink.

It is preferable that an inkjet recording apparatus according to a further aspect of the present invention further includes a maintenance unit having a cap for keeping nozzles of the inkjet head moist, and that the temperature adjustment mechanism is provided in a portion or entirety of a surface of the cap on an opposite side to the surface which keeps the nozzles moist; and when adjusting the temperature of the platen, the cap is separated from the maintenance unit, and the cap is fixed to the inkjet head.

According to the inkjet recording apparatus relating to the further aspect of the present invention, a temperature adjustment mechanism is provided on a cap for keeping the nozzles moist, and when the temperature of the platen is adjusted, the cap including the temperature adjustment mechanism is separated from the maintenance unit and is fixed to the inkjet head. By this means, it is possible to carry out heating or cooling of the platen by performing a scanning action of the carriage.

In an inkjet recording apparatus according to a further aspect of the present invention, it is preferable that the temperature adjustment mechanism is provided on the cap via a heat insulating material.

According to the inkjet recording apparatus relating to the further aspect of the present invention, since a temperature adjustment mechanism is provided on the cap via a heat insulating material, then it is possible to prevent the heat of the temperature adjustment mechanism from being transmitted to the inkjet head via the cap. Consequently, it is possible to prevent increase in the viscosity of the ink in the inkjet head.

In an inkjet recording apparatus according to a further aspect of the present invention, it is preferable that waste liquid inside the cap is previously expelled at the start of temperature adjustment of the platen.

According to the inkjet recording apparatus relating to the further aspect of the present invention, it is possible to prevent waste liquid from becoming attached to the platen during temperature adjustment of the platen, by expelling waste liquid in the cap before starting temperature adjustment of the platen.

In an inkjet recording apparatus according to a further aspect of the present invention, it is preferable that the temperature adjustment mechanism is a heater or a fan.

According to the inkjet recording apparatus relating to the further aspect of the present invention, by using a heater and a fan as a temperature adjustment mechanism, it is possible to blow a warm air flow when the fan is operated with the heater switched on, and therefore the platen can be heated. Furthermore, when the fan is operated without switching on the heater, it is possible to blow a flow of cool air and therefore the platen can be cooled.

In an inkjet recording apparatus according to a further aspect of the present invention, it is preferable that the temperature adjustment mechanism is a heating lamp which heats the platen by a non-contact method.

According to the inkjet recording apparatus relating to the further aspect of the present invention, it is possible to heat the platen without making contact with the platen, by using a heating pump as the temperature adjustment mechanism.

In an inkjet recording apparatus according to a further aspect of the present invention, it is preferable that the temperature adjustment mechanism is a high thermal conductivity roller which cools the platen by making contact with the platen.

According to the inkjet recording apparatus relating to the further aspect of the present invention, by using a high thermal conductivity roller as the temperature adjustment mechanism, it is possible to carry out cooling of the platen by bringing the roller into contact with the platen and absorbing heat in the roller.

According to the inkjet recording apparatus of the present invention, it is possible to perform temperature adjustment of the platen using the scanning device of the carriage, by means of a temperature adjustment mechanism which is provided on the carriage, or which is provided detachably on the carriage, and therefore it is possible to carry out temperature adjustment of the whole platen, even though the temperature adjustment mechanism is compact in size. Furthermore, since cooling of the platen can also be carried out, then it is possible to adjust the platen to a desired temperature.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

First Embodiment (General Composition of Inkjet Recording Apparatus)

Figure 1:
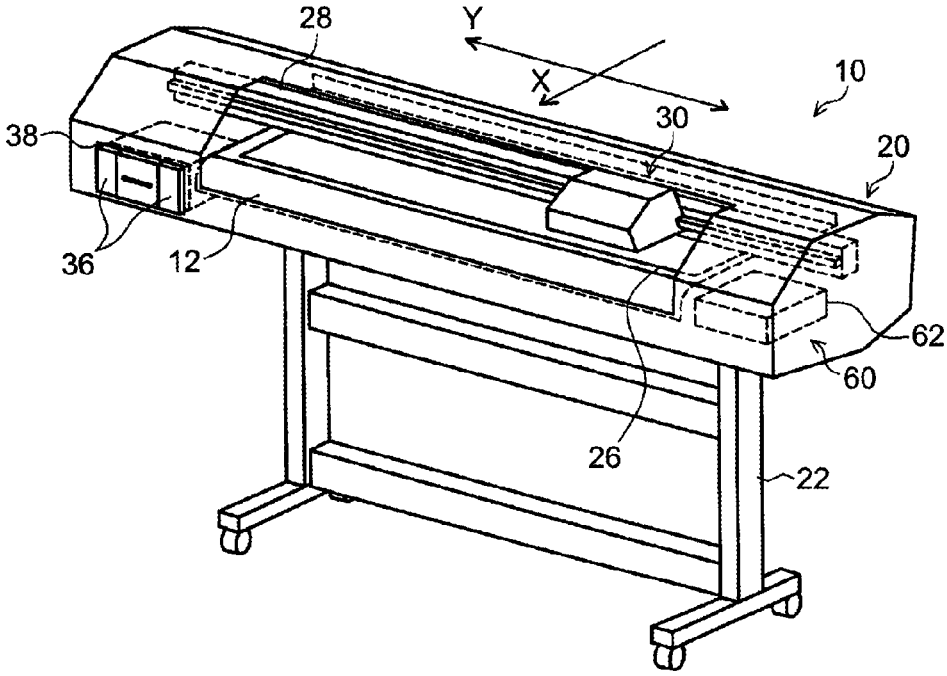
FIG. 1 is an external perspective diagram of an inkjet recording apparatus.

FIG. 1 is an external perspective drawing of an inkjet recording apparatus relating to an embodiment of the present invention. This inkjet recording apparatus 10 is a wide-format printer which forms a color image on the recording medium 12 by using a dryable ink. A wide-format printer is an apparatus which is suitable for recording a wide image formation range, such as for large posters or commercial wall advertisements, or the like. Here, a printer corresponding to a medium having a size of super A3 or greater is called "wide-format".

The inkjet recording apparatus 10 includes an apparatus main body 20 and a stand 22 which supports the apparatus main body 20. The apparatus main body 20 includes a carriage 30 incorporating a drop-on-demand type of inkjet head (not shown in FIG. 1 and indicated by reference numeral 24 in FIG. 3) which ejects ink toward a recording medium (medium) 12, a platen 26 which supports the recording medium 12, and a guide mechanism 28 which forms a head movement device (scanning device).

The guide mechanism 28 is disposed so as to extend above the platen 26, following a scanning direction (called the main scanning direction or the Y direction below) which is parallel to a medium supporting surface of the platen 26 and which is perpendicular to the conveyance direction (called the sub-scanning direction or X direction below) of the recording medium 12. The carriage 30 is supported so as to be able to perform reciprocal movement in the Y direction along a guide mechanism 28.

The inkjet head 24 which is arranged on the carriage 30 moves in unison with (together with) the carriage 30 along the guide mechanism 28. The reciprocal movement direction (Y direction) of the carriage 30 corresponds to the "main scanning direction" and the conveyance direction (X direction) of the recording medium 12 corresponds to the "sub-scanning direction".

Various media may be used for the recording medium 12, without any restrictions on the material, such as paper, unwoven cloth, vinyl chloride, compound chemical fibers, polyethylene, polyester, tarpaulin, or the like, or whether the medium is permeable or non-permeable. The recording medium 12 is supplied in a rolled state (see FIG. 2) from the rear surface of the apparatus, and after printing, the medium is rolled onto a take-up roller on the front side of the apparatus (not shown in FIG. 1 and reference numeral 44 in FIG. 2). Ink droplets are ejected from the inkjet head 24 onto the recording medium 12 which is conveyed on the platen 26.

In FIG. 1, the installation section 38 of an ink cartridge 36 is provided on the left-side front face of the apparatus main body 20 when the apparatus is viewed from the front. The ink cartridge 36 is a replaceable ink supply source (ink tank) which stores ink. The ink cartridge 36 is provided so as to correspond to respective inks which are used in the inkjet recording apparatus 10 of the present example.

The respective ink cartridges 36 of each color are respectively connected to the inkjet head 24 by ink supply channels (not illustrated) which are formed independently. The ink cartridges 36 are replaced respectively when the amount of remaining ink of the respective colors has become low.

A maintenance unit 60 of the inkjet head 24 is provided on the right-hand side along the front surface of the apparatus main body 20. This maintenance unit 60 includes a cap 62 for keeping the inkjet head 24 moist when not printing, and a wiping member (blade, web, etc.) (not illustrated) for cleaning the nozzle surface (ink ejection surface) of the inkjet head 24. The cap 62 which caps the nozzle surface of the inkjet head 24 is provided with an ink receptacle for receiving ink droplets ejected from the nozzles for the purpose of maintenance.

(Description of Recording Medium Conveyance Path)

Figure 2:
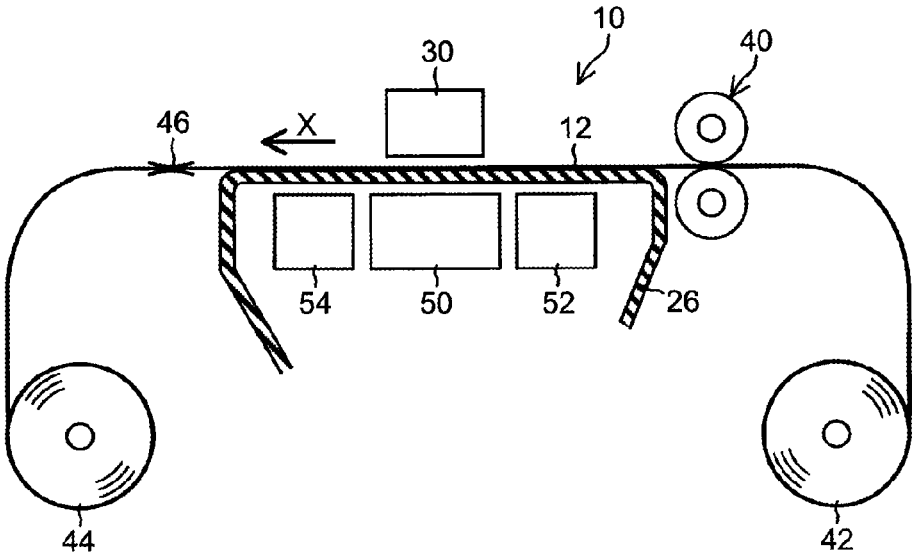
FIG. 2 is an illustrative diagram which shows a schematic drawing of a paper conveyance path in the inkjet recording apparatus shown in FIG. 1.

FIG. 2 is an illustrative diagram showing a schematic view of the recording medium conveyance path in the inkjet recording apparatus 10. As shown in FIG. 2, the platen 26 is formed in an inverted gutter shape and the upper surface thereof is a supporting surface (medium supporting surface) for a recording medium 12. A pair of nip rollers 40 which form a recording medium conveyance device for intermittently conveying the recording medium 12 are provided on the upstream side of the platen 26 in the recording medium conveyance direction (X direction), in the vicinity of the platen 26. These nip rollers 40 move the recording medium 12 in the recording medium conveyance direction over the platen 26.

The recording medium 12 which is output from a supply side roll (pay-out supply roll) 42 that constitutes a roll-to-roll type medium conveyance device is conveyed intermittently in the recording medium conveyance direction by the pair of nip rollers 40 which are provided in an inlet opening of the print unit (on the upstream side of the platen 26 in terms of the recording medium conveyance direction). When the recording medium 12 has arrived at the print unit directly below the inkjet head 24, printing is carried out by the inkjet head 24, and the recording medium is then wound up onto a take-up roll 44 after printing. A guide 46 for the recording medium 12 is provided on the downstream side of the print unit in the recording medium conveyance direction.

A temperature adjustment unit 50 for adjusting a temperature of the recording medium 12 during printing is provided on a rear surface of the platen 26 (a surface on the opposite side to the surface which supports the recording medium 12), which is situated in a position opposing the inkjet head 24 in the print unit. When the recording medium 12 is adjusted to a prescribed temperature during printing, the viscosity, surface tension, and other physical properties, of the ink droplets deposited onto the recording medium 12, assume prescribed values and it is possible to obtain a desired dot diameter. According to requirements, it is possible to provide a heat pre-adjustment unit 52 on the upstream side of the temperature adjustment unit 50 or to provide a heat post-adjustment unit 54 on the downstream side of the temperature adjustment unit 50.

(Composition of Image Forming Unit)

Figure 3:
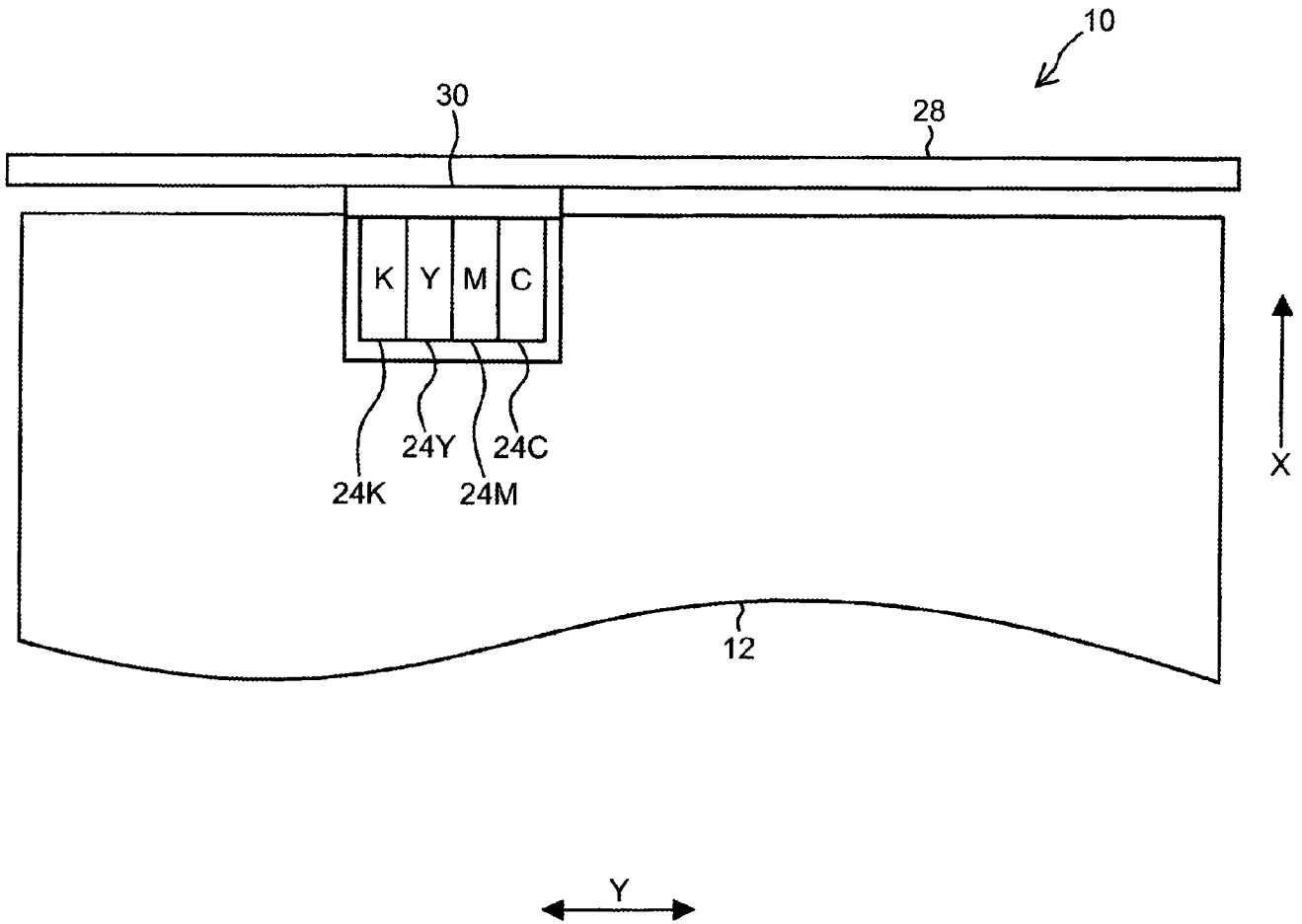
FIG. 3 is a plan view perspective diagram showing an example of the inkjet head shown in FIG. 1.

FIG. 3 is a plan diagram showing a composition of an image forming unit, and depicts an arrangement mode of inkjet heads 24 which are arranged on a carriage 30.

In the inkjet head 24, inkjet heads 24K, 24Y, 24M, 24C for ejecting inks of respective colors are provided for each of the ink colors: black (K), yellow (Y), magenta (M) and cyan (C). The types of ink color (number of colors) and the combination of colors are not limited to those of the present embodiment.

For example, it is possible to adopt a mode in which inkjet heads for light cyan (LC) and light magenta (LM) are provided, or a mode in which a plurality of inkjet heads are provided for colors having a high use frequency, and so on. Furthermore, the arrangement sequence of the inkjet heads 24K, 24Y, 24M, 24C of the different colors is not limited in particular.

Moreover, it is also possible to constitute an inkjet head including nozzles (nozzle rows) of a plurality of colors. In this description, unless it is necessary to distinguish between the inkjet heads of the respective colors, the letter indicating the color is omitted and the description refers simply to inkjet head(s) 24.

Figure 4:
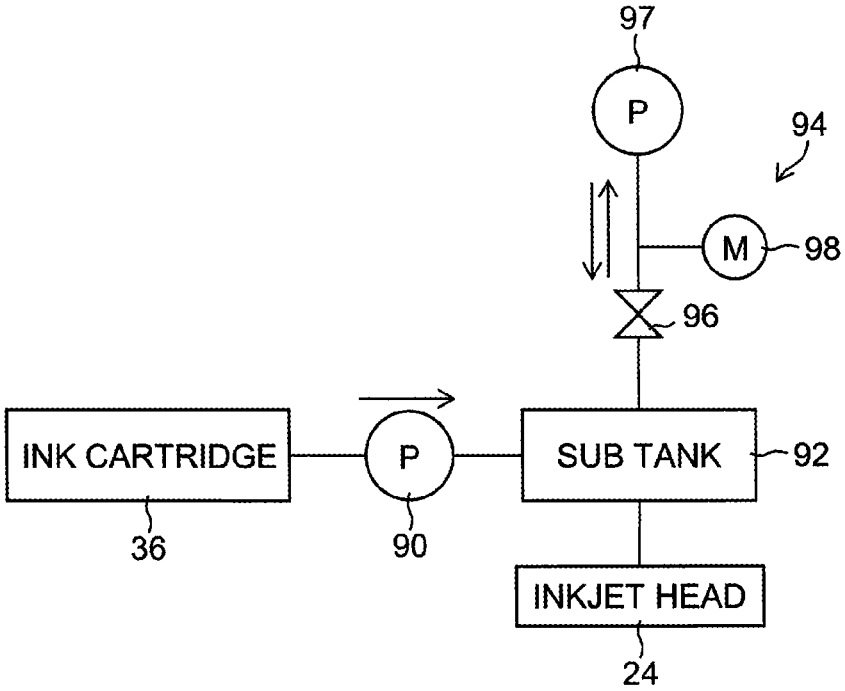
FIG. 4 is a block diagram showing a configuration of an ink supply system of the inkjet recording apparatus shown in FIG. 1.

FIG. 4 is a block diagram showing a composition of an ink supply system of the inkjet recording apparatus 10. As shown in FIG. 4, ink accommodated in an ink cartridge 36 is suctioned by the supply pump 90, and is conveyed to the inkjet head 24 via a sub-tank 92. A pressure adjustment unit 94 for adjusting the pressure of the ink therein is provided in the sub-tank 92.

The pressure adjustment unit 94 includes a pressure reducing pump 97 which is connected to the sub tank 92 by means of a valve 96, and a pressure gauge 98 which is provided between the valve 96 and the pressure reducing pump 97.

During normal printing, the pressure reducing pump 97 operates in a direction which suctions ink inside the sub-tank 92, and keeps the internal pressure of the sub-tank 92 and the internal pressure of the inkjet head 24 to a negative pressure. On the other hand, during maintenance of the inkjet head 24, the pressure reducing pump 97 is operated in a direction which increases the pressure of the ink inside the sub tank 92, thereby forcibly raising the internal pressure of the sub-tank 92 and the internal pressure of the inkjet head 24, and ink inside the inkjet head 24 is expelled via nozzles. The ink which has been forcibly expelled from the inkjet head 24 is accommodated in the ink receptacle of the cap 62 described above.

In the inkjet recording apparatus 10 described in the present embodiment, the ink temperature is adjusted so as to be kept within a uniform range, in the ink supply system shown in FIG. 4. As a compositional example for keeping a uniform ink temperature, a temperature sensor for measuring a temperature in a sub tank 92 and heater are provided in an ink flow channel which supplies ink from the sub tank 92 to the inkjet head 24, and a heater is operated on the basis of the determination results of the temperature sensor.

Furthermore, a desirable mode is one in which the portion where ink passes from the ink cartridge 36 to the inkjet head 24 is covered with a heat insulating material, in such a manner that the ink is not affected by external temperature changes. Moreover, a desirable mode is one where a heater is provided inside the inkjet head 24 and the temperature is managed inside the inkjet head 24.

(Description of Inkjet Recording Apparatus Control System)

Figure 5:
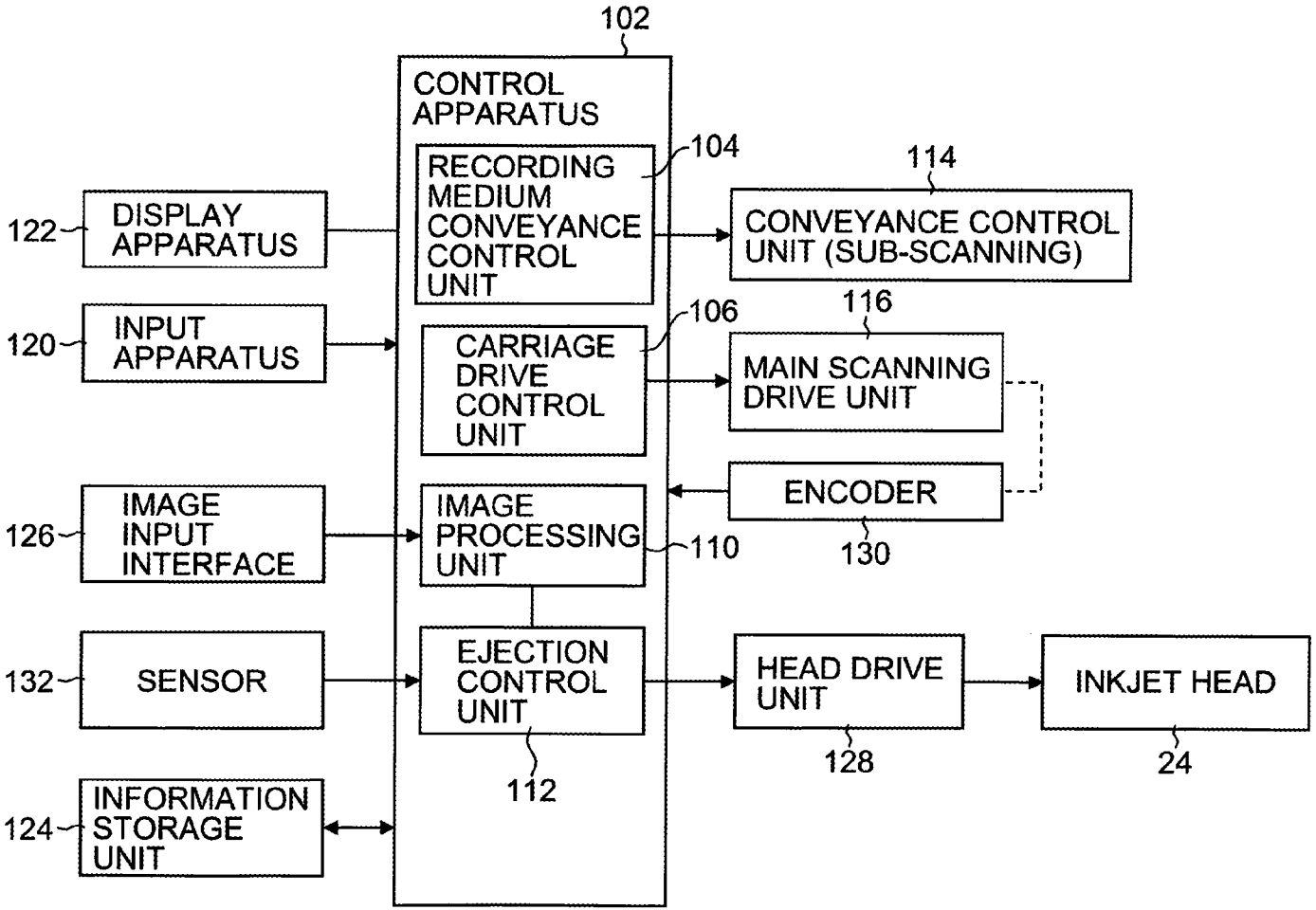
FIG. 5 is a block diagram showing a principal composition of the control system of the inkjet recording apparatus shown in FIG. 1.

FIG. 5 is a block diagram of the main composition of a control system an inkjet recording apparatus 10. As shown in FIG. 5, the inkjet recording apparatus 10 is provided with a control apparatus 102 as a control device.

For this control apparatus 102, it is possible to use, for example, a computer equipped with a central processing unit (CPU), or the like. The control apparatus 102 functions as a control apparatus for controlling the whole of the inkjet recording apparatus 10 in accordance with a prescribed program, as well as functioning as a calculation apparatus for performing respective calculations.

The control apparatus 102 includes a recording medium conveyance control unit 104, a carriage drive control unit 106, an image processing unit 110, and an ejection control unit 112. These respective units are achieved by a hardware circuit or software, or a combination of these.

The recording medium conveyance control unit 104 controls the conveyance drive unit 114 for conveying the recording medium 12 (see FIG. 1). The conveyance drive unit 114 includes a drive motor which drives the nip rollers 40 shown in FIG. 2, and a drive circuit thereof. The recording medium 12 which is conveyed on the platen 26 (see FIG. 1) is conveyed intermittently in the sub-scanning direction, in accordance with a reciprocal scanning action (printing pass action) in the main scanning direction performed by the inkjet head 24.

The carriage drive control unit 106 shown in FIG. 5 controls the main scanning drive unit 116 for moving the carriage 30 (see FIG. 1) in the main scanning direction. The main scanning drive unit 116 includes a drive motor which is connected to a movement mechanism of the carriage 30, and a control circuit thereof.

An input apparatus 120, such as an operating panel, and a display apparatus 122, are connected to the control apparatus 102. The input apparatus 120 is a device by which manually performed external operating signals are input to the control apparatus 102, and may employ various formats, such as a keyboard, a mouse, a touch panel, or operating buttons, or the like. The display apparatus 122 may employ various formats, such as a liquid crystal display, an organic EL display, a CRT, or the like.

An operator is able to select an image formation mode (identical to "image formation format"), input print conditions, and input and edit additional conditions, and the like, by operating the input apparatus 120, and is able to confirm the input details and various information such as search results, via the display on the display apparatus 122.

Furthermore, an information storage unit 124 which stores various information and an image input interface (I/F) 126 for acquiring image data for printing are provided in the inkjet recording apparatus 10. It is possible to employ to this interface a serial interface or a parallel interface for the image input interface. It is also possible to install a buffer memory (not illustrated) for achieving high-speed communications.

The image data input via the image input interface 126 is converted into data for printing (dot data) by the image processing unit 110. In general, the dot data is generated by subjecting the multiple-tone image data to color conversion processing and half-tone processing. The color conversion processing is processing for converting image data represented by an sRGB system (for example, 8-bit image data of respective colors of RGB) into image data of the respective colors of ink used by the inkjet recording apparatus 10.

A half-toning process is processing for converting the color data of the respective colors generated by the color conversion processing into dot data of respective colors by error diffusion, a threshold value matrix, or the like. The device carrying out the half-toning process may employ commonly known methods of various kinds, such as an error diffusion method, a dithering method, a threshold value matrix method, a density pattern method, and the like. The half-toning process generally converts tonal image data having M values ($M \geq 3$) into tonal image data having N values ($N < M$). In the simplest example, the image data is converted into dot image data having 2 values (dot on/dot off), but in a half-toning process, it is also possible to perform quantization in multiple values which correspond to different types of dot size (for example, three types of dot: a large dot, a medium dot and a small dot).

The binary or multiple-value image data (dot data) obtained in this way is used for driving (on) or not driving (off) the respective nozzles, or in the case of multiple-value data, is used as ink ejection data (droplet control data) for controlling the droplet volume (dot size).

The ejection control unit 112 generates an ejection control signal for the head drive unit 128 on the basis of dot data generated in the image processing unit 110. Furthermore, the ejection control unit 112 includes a drive waveform generation unit (not shown). The drive waveform generation unit is a device which generates a voltage waveform for driving the ejection energy generation elements (in the present embodiment, piezo elements) which correspond to the respective nozzles of the inkjet head 24. The waveform data is stored previously in the information storage unit 124 and drive waveform data to be used is output as and when required. The drive waveform output from the drive waveform generation unit is supplied to the head drive unit 128. The signal output from the drive waveform generation unit may be digital waveform data or an analog voltage signal.

Ink is ejected from the corresponding nozzles by applying a common drive voltage to the ejection energy generation devices of the inkjet head 24 via the head drive unit 128 and switching the switching elements (not illustrated) which are connected to the individual electrodes of the energy generating elements on and off in accordance with the ejection timings of the respective nozzles.

Programs to be executed by the CPU of the system controller 102 and various data required for control purposes are stored in the information storage unit 124. The information storage unit 124 stores resolution settings information corresponding to the image formation mode, the number of passes (number of scanning repetitions), scanning volume information necessary for controlling scanning volume, and control information and the like.

An encoder 130 is attached to the drive motor of the main scanning drive unit 116 and the drive motor of the conveyance drive unit 114, and outputs a pulse signal corresponding to the amount of rotation and the speed of rotation of the drive motor, this pulse signal being supplied to the control apparatus 102. The position of the carriage 30 and the position of the recording medium 12 (see FIG. 1) are ascertained on the basis of the pulse signal output from the encoder 130.

A sensor 132 is installed on the carriage 30, and the width of the recording medium 12 is ascertained on the basis of a sensor signal obtained from the sensor 132. The composition shown in FIG. 5 can be suitably modified, added or deleted.

(Image Formation Mode)

The inkjet recording apparatus 10 shown in this embodiment employs multi-pass image formation control, and the print resolution (recording resolution) can be varied by changing the number of printing passes. For example, three image formation modes are used: high-productivity mode, standard mode, high-quality mode, and the print resolution is different in each respective mode. It is possible to select the image formation mode in accordance with the print objective and application.

In high-productivity mode, printing is carried out at a resolution of 600 dots per inch (main scanning direction) by 400 dots per inch (sub-scanning direction). In high-productivity mode, a resolution of 600 dots per inch is achieved by two passes (two scanning actions) in the main scanning direction. In the first scanning action (the outward movement of the carriage 30), dots are formed at a resolution of 300 dots per inch.

In the second scanning action (return movement), dots are formed so as to be interpolated at 300 dots per inch between the dots formed by the first scanning action (outward movement), and a resolution of 600 dots per inch is obtained in the main scanning direction.

On the other hand, the nozzle pitch is 100 dots per inch in the sub-scanning direction, and dots are formed at a resolution of 100 dots per inch in the sub-scanning direction by one main scanning action (one pass). Consequently, a resolution of 400 dots per inch is achieved by performing interpolated printing so as to cover the spaces in the nozzle pitch, by four-pass printing (four scanning actions).

The main scanning speed of the carriage 30 in high-productivity mode is 1270 millimeters per second.

In standard mode, printing is carried out at a resolution of 600 dots per inch by 800 dots per inch, and this 600 dots per inch by 800 dots per inch resolution is achieved by means of two-pass printing in the main scanning direction and eight-pass printing in the sub-scanning direction.

In high-quality mode, printing is carried out at a resolution of 1200 dots per inch by 1200 dots per inch, and this 1200 dots per inch by 1200 dots per inch resolution is achieved by means of four passes in the main scanning direction and twelve passes in the sub-scanning direction.

(Temperature Adjustment of the Platen)

Figure 6A:
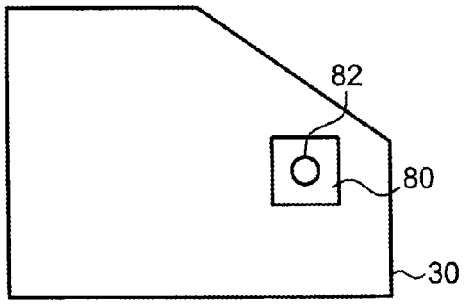
FIG. 6A is a side view diagram of a carriage of the inkjet recording apparatus relating to the first embodiment.
Figure 6B:
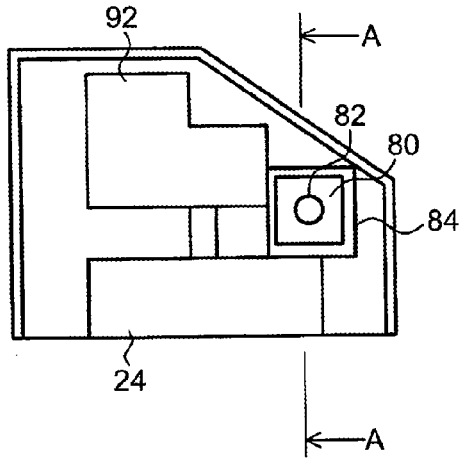
FIG. 6B is a cross-sectional side view of same.
Figure 7:
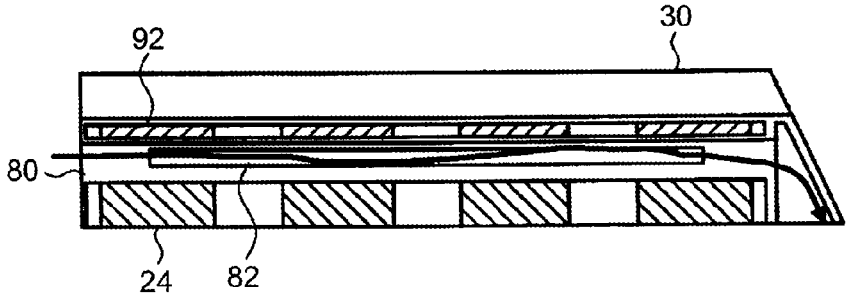
FIG. 7 is a cross-sectional diagram along A-A in FIG. 6B.

In the present embodiment, temperature adjustment of the platen is carried out by using a carriage scanning device. FIG. 6A is a side view diagram of the carriage 30 and FIG. 6B is a cross-sectional diagram of the carriage 30. Furthermore, FIG. 7 is a cross-sectional diagram along A-A in FIG. 6B.

The temperature adjustment of the platen 26 according to the present embodiment is effective in cases where temperature adjustment of the platen 26 is carried out at times other than during image formation, for instance, at the start of image formation or when changing the recording medium.

In the present embodiment, a gas flow channel 80 along which air passes in the scanning direction of the carriage 30 is provided on a side face of the carriage 30. As shown in FIG. 7, the gas flow channel 80 is formed in such a manner that air can pass from one side surface of the carriage 30, through the interior of the carriage 30, to the bottom surface of the carriage 30, in other words, the side of the platen 26.

A heater 82 is arranged as a temperature adjustment mechanism inside the gas flow channel 80. When the platen 26 is to be heated, the power of the heater 82 is switched on, thereby heating the air passing through the gas flow channel 80, and therefore the platen 26 can be heated by this heated air. Furthermore, when cooling the platen 26, cool air can be supplied to the platen 26 by passing air through the gas flow channel 80 in a state where the power supply to the heater 82 is switched off, and hence cooling of the platen 26 can be performed.

Desirably, a heat insulating material 84 is provided about the periphery of the gas flow channel 80. By providing this heat insulating material 84, it is possible to prevent the heat of the heater 82 from being transmitted to the inkjet heads 24 and the sub tanks 92. It is not desirable if the heat of the heater 82 is transmitted to the ink inside the inkjet heads 24 and the sub-tanks 92, since this leads to increase in the viscosity of the ink, and so on.

For the heat insulating material, it is possible to use polymide resin, glass wool, rock wool, and the like.

Furthermore, when cooling the platen 26, it is possible to use a heat sink instead of a heater 82. By using a heat sink, it is possible to cool the air passing inside the gas flow channel 80, and therefore the cooling of the platen 26 can be carried out efficiently. If a heat sink is used inside the gas flow channel 80, then it is not possible to carry out heating, and therefore, it is desirable to carry out heating by the temperature adjustment unit 50 which is provided on the rear surface side of the platen, as shown in FIG. 2.

By performing a scanning action of the carriage 30 which is composed in this way, with the side surface in which the gas flow channel 80 is provided on the forward side of the direction of travel (moving from the right side to the left side in FIG. 7), air passes through the gas flow channel 80, as indicated by the arrow in FIG. 7, and can be blown onto the platen 26, whereby heating or cooling of the platen 26 can be performed.

Second Embodiment

Next, an inkjet recording apparatus relating to a second embodiment will be described. The inkjet recording apparatus relating to the second embodiment differs from the first embodiment in using a temperature adjustment mechanism which is provided in a cap 62 of the maintenance unit 60, for the heating and cooling of the platen 26.

Figure 8:
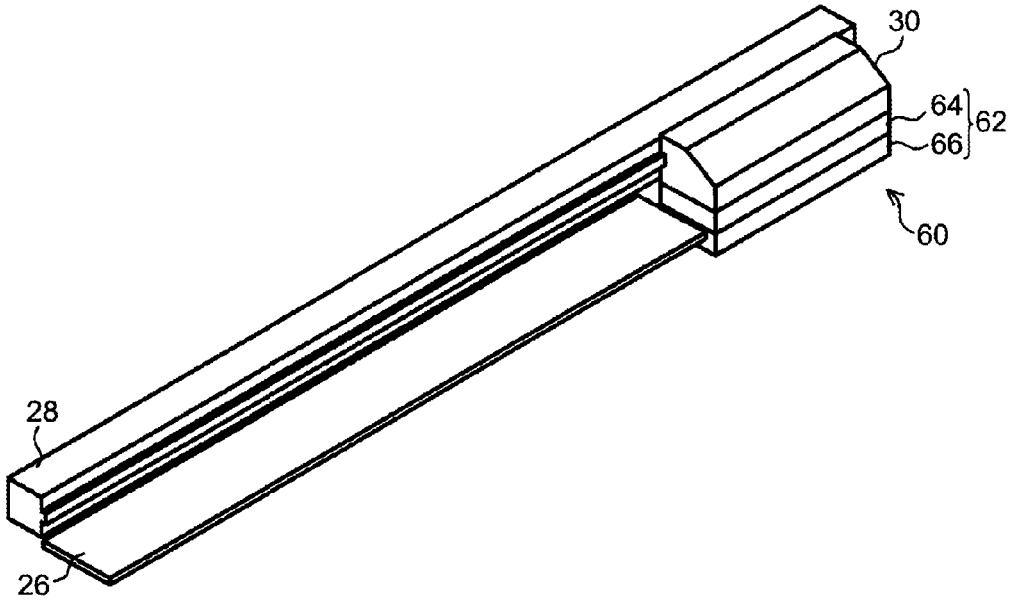
FIG. 8 is an external perspective drawing of an inkjet recording apparatus relating to a second embodiment of the present invention when not printing.
Figure 9:
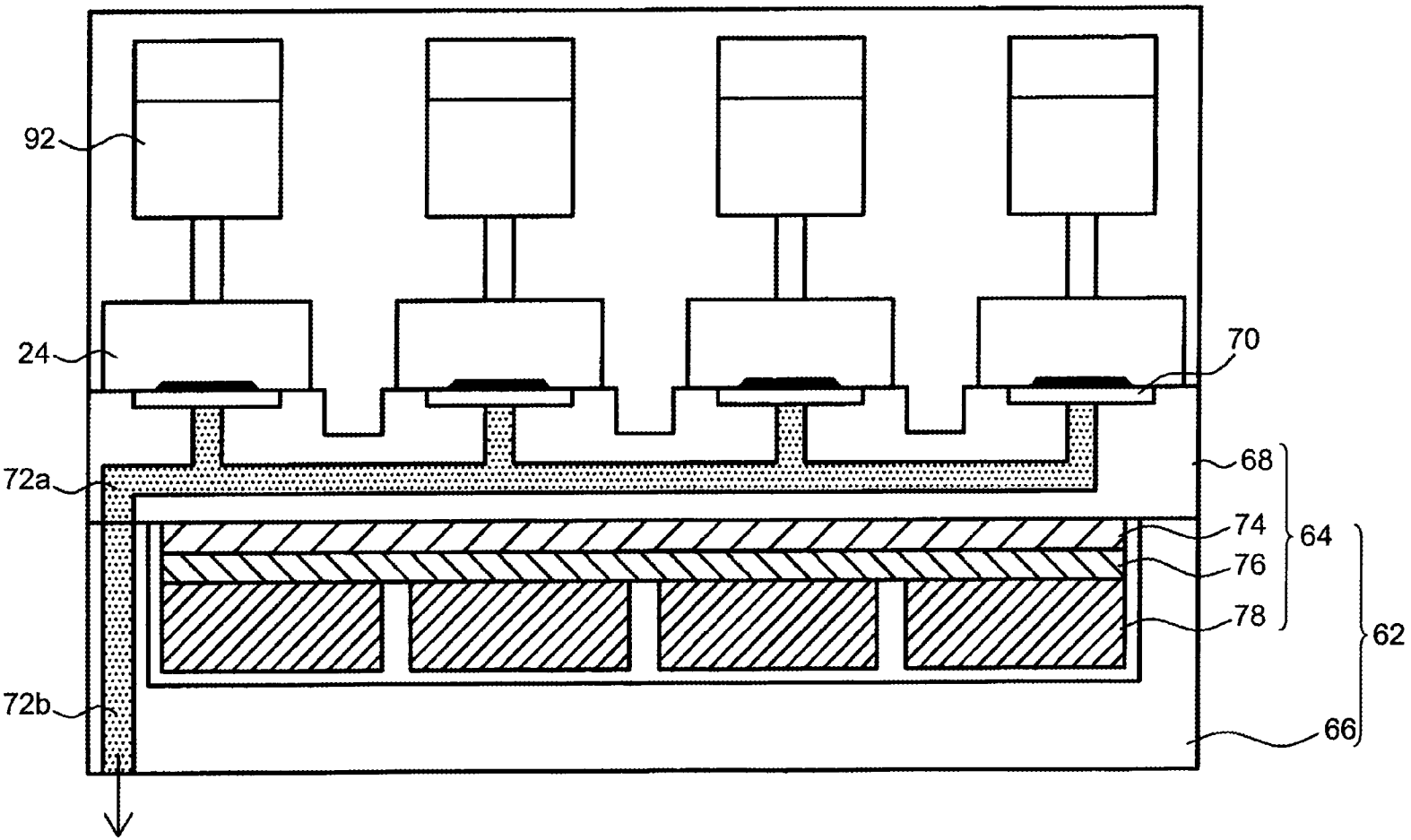
FIG. 9 is a front surface cross-sectional diagram of a maintenance unit of the inkjet recording apparatus illustrated in FIG. 8.

FIG. 8 is a perspective diagram showing a state of an inkjet recording apparatus 10 when printing has been halted, and FIG. 9 is a front surface cross-sectional diagram of same. In order to simplify the illustration, FIG. 8 only depicts a carriage 30, a guide mechanism 28 as a scanning device for the carriage 30, a platen 26 and a maintenance unit 60.

As shown in FIG. 8 and FIG. 9, when printing is halted, the inkjet heads are capped with the cap 62 of the maintenance unit 60, in order to keep the inkjet heads moist. During image formation, if there are nozzles which do not perform droplet ejection at all, or which have a low droplet ejection frequency, due to the image data, and in particular, when continuously forming a plurality of prints of the same image, increase in the ink viscosity and nozzle blockages are liable to occur in particular nozzles. Therefore, in the maintenance unit 60, purging (dummy ejection, preliminary ejection) of nozzles having a low frequency of droplet ejection is carried out appropriately so as to expel ink from nozzles not performing droplet ejection or nozzles having a low frequency of droplet ejection.

In the present embodiment, the maintenance unit 60 is composed in such a manner that a cap upper part 64 and a cap lower part 66 are separable. An ink receptacle 70 for receiving ink when the aforementioned purging is carried out, and a liquid drainage pipe 72*a* which conveys ink that has been expelled into the ink receptacle 70, to a waste liquid tank (not illustrated) via a liquid drainage pipe 72*b* in the cap lower part 66, are provided in a cap main body 68 in the cap upper part 64. Furthermore, a heater 76 and a fan 78 are provided as a temperature adjustment mechanism, via a heat insulating material 74, on a surface of the cap upper part 64 on the opposite side to the side of the inkjet heads 24. For the heat insulating material 74, it is possible to use heat insulating materials similar to those of the first embodiment. Moreover, the cap main body 68 is made of rubber, or the like, which has a beneficial effect as a heat insulating material in the cap main body 68 also.

The cap lower part 66 serves as a cover for covering the temperature adjustment mechanism and the liquid drainage pipe 72*b* which conveys ink from the liquid drainage pipe 72*a* of the cap upper part 64 to the waste liquid tank.

The cap upper part 64 and the cap lower part 66 are composed so as to be mutually attachable and detachable by means of hooks (not illustrated), and the cap upper part 64 is composed so as to be installable on the inkjet heads 24.

Figure 10:
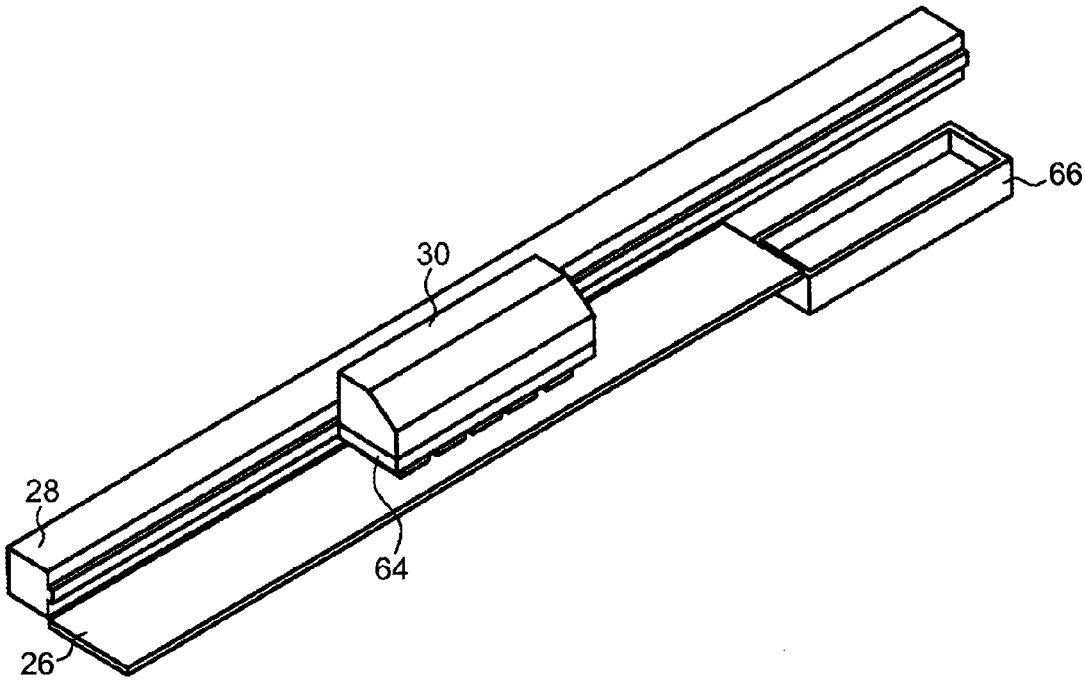
FIG. 10 is an external perspective drawing of an inkjet recording apparatus relating to a second embodiment of the present invention during temperature adjustment.

FIG. 10 is a perspective diagram of a case where temperature adjustment of the platen 26 is carried out by a temperature adjustment mechanism provided in the cap upper part 64. As shown in FIG. 10, during temperature adjustment of the platen 26, the cap upper part 64 is installed on the carriage 30, and temperature control of the platen 26 can be carried out by performing a scanning action of the carriage 30.

Furthermore, during temperature adjustment of the platen 26, it is necessary to make the distance between the inkjet heads 24 and the platen 26 greater than during image formation, in order to be able to install the cap upper part 64 and perform a scanning action of the carriage 30. Consequently, it is desirable to provide a perpendicular movement mechanism (not illustrated) which moves the guide mechanism 28 and the carriage 30 in a perpendicular direction with respect to the platen 26. Although it is also possible to move the platen 26, in terms of the composition of the apparatus, it is desirable to move the carriage 30.

In the second embodiment, a heater 76 and a fan 78 are used as a temperature adjustment mechanism. When heating the platen 26, it is possible to carry out heating of the platen 26 by switching on the power supply of both the heater 76 and the fan 78 and thereby blowing a flow of air that has been warmed by the heater 76, onto the platen 26, by the fan 78.

Moreover, when performing cooling of the platen 26, by switching the power of the heater 76 off and only switching the fan 78 on, it is possible to carry out cooling of the platen 26 by blowing a cool air flow onto the platen 26.

Desirably, the purging described above is carried out so as to expel the ink receptacle 70 before carrying out temperature adjustment. In this way, it is possible to prevent the ink in the ink receptacle 70 or inside the inkjet heads 24 from becoming attached to the platen 26.

Third Embodiment

Figure 11:
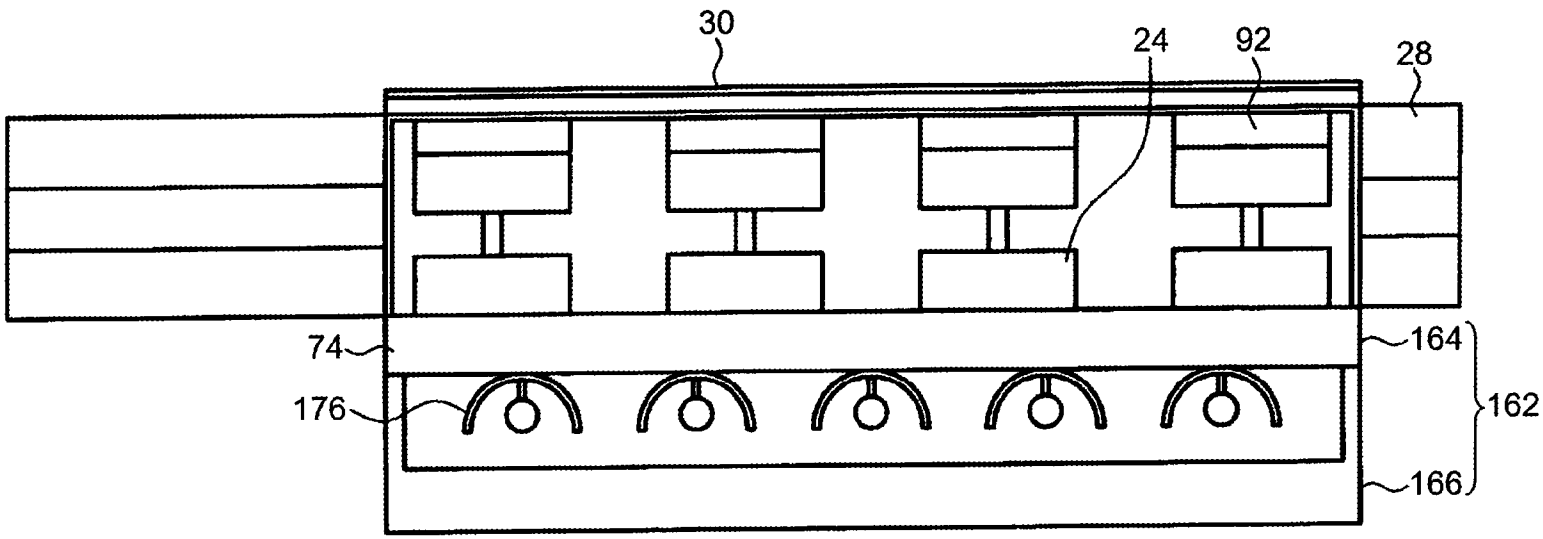
FIG. 11 is a front surface cross-sectional drawing of a maintenance unit of an inkjet recording apparatus relating to a third embodiment of the invention.

FIG. 11 is a cross-sectional diagram of a maintenance unit of an inkjet recording apparatus relating to a third embodiment of the invention. In FIG. 11, the liquid drainage path of the ink produced by purging, and the like, is omitted.

The inkjet recording apparatus relating to the third embodiment differs from the inkjet recording apparatus according to the second embodiment in that a heating lamp 176 is provided as a temperature adjustment mechanism which is provided in a cap upper part 164. There is also a corresponding cap lower part 166, and the cap upper part 164 and the cap lower part 166 constitute a cap 162. There are no particular restrictions on the heating lamp 176, provided that it can heat the platen 26, but it is possible to use a halogen lamp, a xenon lamp, or the like, for example.

When adjusting the temperature of the platen 26, similarly to the second embodiment, it is possible to carry out heating of the platen 26 by performing a scanning action of the carriage 30 with the cap upper part 164 installed on the inkjet heads 24.

Fourth Embodiment

Figure 12:
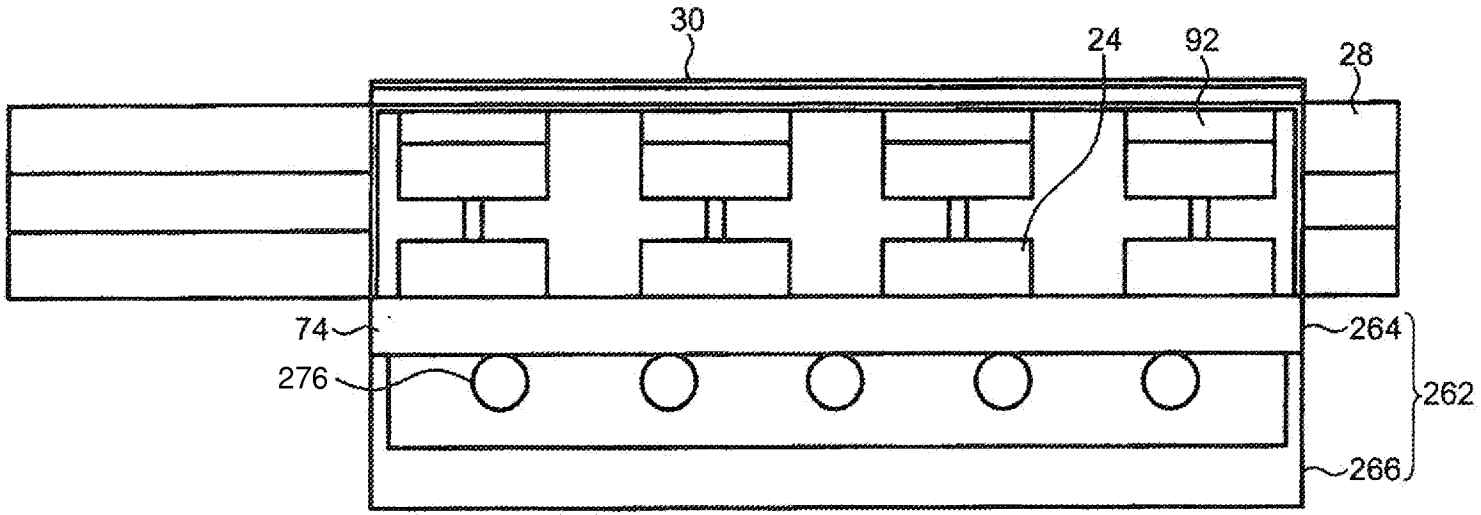
FIG. 12 is a front surface cross-sectional drawing of a maintenance unit of an inkjet recording apparatus relating to a fourth embodiment of the invention.

FIG. 12 is a cross-sectional diagram of a maintenance unit of an inkjet recording apparatus relating to a fourth embodiment of the invention. In FIG. 12, the liquid drainage path of the ink produced by purging, and the like, is omitted.

The inkjet recording apparatus relating to the fourth embodiment differs from the inkjet recording apparatus according to the second and third embodiments in that a high thermal conductivity roller 276 is provided as a cooling mechanism in the temperature adjustment mechanism which is provided in a cap upper part 264. There is also a corresponding cap lower part 266, and the cap upper part 264 and the cap lower part 266 constitute a cap 262.

By installing the cap upper part 264 on which the high thermal conductivity roller 276 is provided, on the inkjet heads 24, and causing the roller 276 to come into contact with the platen 26 while moving the carriage 30, it is possible to absorb the heat of the platen 26 by the roller, and therefore cooling of the platen 26 can be carried out.

In the present invention, high thermal conductivity means a thermal conductivity of no less than 100 W/(m·K), and it is possible to use aluminum, or the like, for the roller.

In the third embodiment and the fourth embodiment, a composition is described in which only a heating mechanism or a cooling mechanism is provided as the temperature adjustment mechanism. The third embodiment is effective in an inkjet recording apparatus which does not require cooling of the platen, and in the fourth embodiment, cooling of the platen is carried out by using the scanning device of the carriage 30, and heating of the platen 26 is carried out by using a temperature adjustment unit 50 which is formed on a rear surface of the platen 26 shown in FIG. 2.

Furthermore, in the description given above, a dryable ink is used, but the present invention is not limited to a dryable ink, and can also be implemented when using a radiation beam (active light beam)-curable ink (UV-curable ink) which is cured by an active light beam. In the case of a radiation beam-curable ink, curing of the ink is performed by providing a provisional curing light source and a main curing light source inside the carriage 30, but the temperature control of the platen 26 can be carried out by a similar method to when using a dryable ink.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a carriage incorporating an image forming unit which forms an image on a recording medium by ejecting ink from an inkjet head;

a scanning device which scans the recording medium by bi-directionally moving the carriage along a direction perpendicular to a direction of conveyance of the recording medium;

a platen arranged opposite the carriage and supporting the recording medium from a rear surface side thereof;

a temperature control device carrying out temperature control of the platen by a temperature adjustment mechanism provided on the carriage or is provided detachably, wherein the temperature control device carries out temperature control throughout the whole range of the platen in the width direction, by moving the carriage by the scanning device; and a maintenance unit having a cap for keeping nozzles of the inkjet head moist, wherein the temperature adjustment mechanism is provided in a portion or entirety of a surface of the cap on an opposite side to the surface which keeps the nozzles moist; and when adjusting the temperature of the platen, the cap is separated from the maintenance unit, and the cap is fixed to the inkjet head.

2. The inkjet recording apparatus as defined in claim 1, wherein the temperature adjustment mechanism is provided on the cap via a heat insulating material.

3. The inkjet recording apparatus as defined in claim 2, wherein waste liquid inside the cap is previously expelled at the start of temperature adjustment of the platen.

4. The inkjet recording apparatus as defined in claim 3, wherein the temperature adjustment mechanism is a heater or a fan.

5. The inkjet recording apparatus as defined in claim 3, wherein the temperature adjustment mechanism is a heating lamp which heats the platen by a non-contact method.

6. The inkjet recording apparatus as defined in claim 3, wherein the temperature adjustment mechanism is a high thermal conductivity roller which cools the platen by making contact with the platen.

7. The inkjet recording apparatus as defined in claim 2, wherein the temperature adjustment mechanism is a heater or a fan.

8. The inkjet recording apparatus as defined in claim 2, wherein the temperature adjustment mechanism is a heating lamp which heats the platen by a non-contact method.

9. The inkjet recording apparatus as defined in claim 2, wherein the temperature adjustment mechanism is a high thermal conductivity roller which cools the platen by making contact with the platen.

10. The inkjet recording apparatus as defined in claim 1, wherein waste liquid inside the cap is previously expelled at the start of temperature adjustment of the platen.

11. The inkjet recording apparatus as defined in claim 10, wherein the temperature adjustment mechanism is a heater or a fan.

12. The inkjet recording apparatus as defined in claim 10, wherein the temperature adjustment mechanism is a heating lamp which heats the platen by a non-contact method.

13. The inkjet recording apparatus as defined in claim 10, wherein the temperature adjustment mechanism is a high thermal conductivity roller which cools the platen by making contact with the platen.

14. The inkjet recording apparatus as defined in claim 1, wherein the temperature adjustment mechanism is a heater or a fan.

15. The inkjet recording apparatus as defined in claim 1, wherein the temperature adjustment mechanism is a heating lamp which heats the platen by a non-contact method.

16. The inkjet recording apparatus as defined in claim 1, wherein the temperature adjustment mechanism is a high thermal conductivity roller which cools the platen by making contact with the platen.

* * * * *